United States Patent [19]

Sokol

[11] 4,262,605

[45] Apr. 21, 1981

[54] NESTABLE UNITIZED SHELVING SYSTEM

[76] Inventor: Filip L. Sokol, 1620 Mapleton Ave., Boulder, Colo. 80302

[21] Appl. No.: 38,786

[22] Filed: May 14, 1979

[51] Int. Cl.[3] ..... A47B 47/00

[52] U.S. Cl. ..... 108/91; 108/111; 312/107

[58] Field of Search ..... 108/91, 53.3, 109, 111; 220/23.6; 206/499, 514; 46/24, 15; 229/9, 19; 312/107

[56] References Cited

U.S. PATENT DOCUMENTS

| | | | |
|---|---|---|---|
| 85,811 | 1/1869 | Gill | 312/107 |
| 243,362 | 6/1881 | Crandall | 46/24 |
| 985,924 | 3/1911 | Nelson | 108/109 |
| 1,499,553 | 7/1924 | Rollman | 206/519 |
| 1,660,119 | 2/1928 | Decker | 46/15 |
| 2,128,854 | 8/1930 | Sagendorph | 312/107 |
| 3,949,928 | 4/1976 | Perkins | 229/19 |

FOREIGN PATENT DOCUMENTS

| | | | |
|---|---|---|---|
| 41098 | 10/1909 | Austria | 108/91 |

*Primary Examiner*—Francis K. Zugel
*Attorney, Agent, or Firm*—Robert C. Dorr

[57] ABSTRACT

A shelving system having a first series of nestable shelving units and a second series of nestable shelving units. All units in the first series are nestable one within the other and all units in the second series are nestable one within the other. When both unitized series are fully nested, the second series nests within the first series in an orthogonal relationship. The sides of all units are designed so that a plurality of predetermined heights corresponding to the heights of different units can be achieved by the unitized shelving system when assembled.

1 Claim, 15 Drawing Figures

30
20
10

15
10
A2
SERIES 1
SERIES 2
C1
B1
A1
B2
C2
20
30

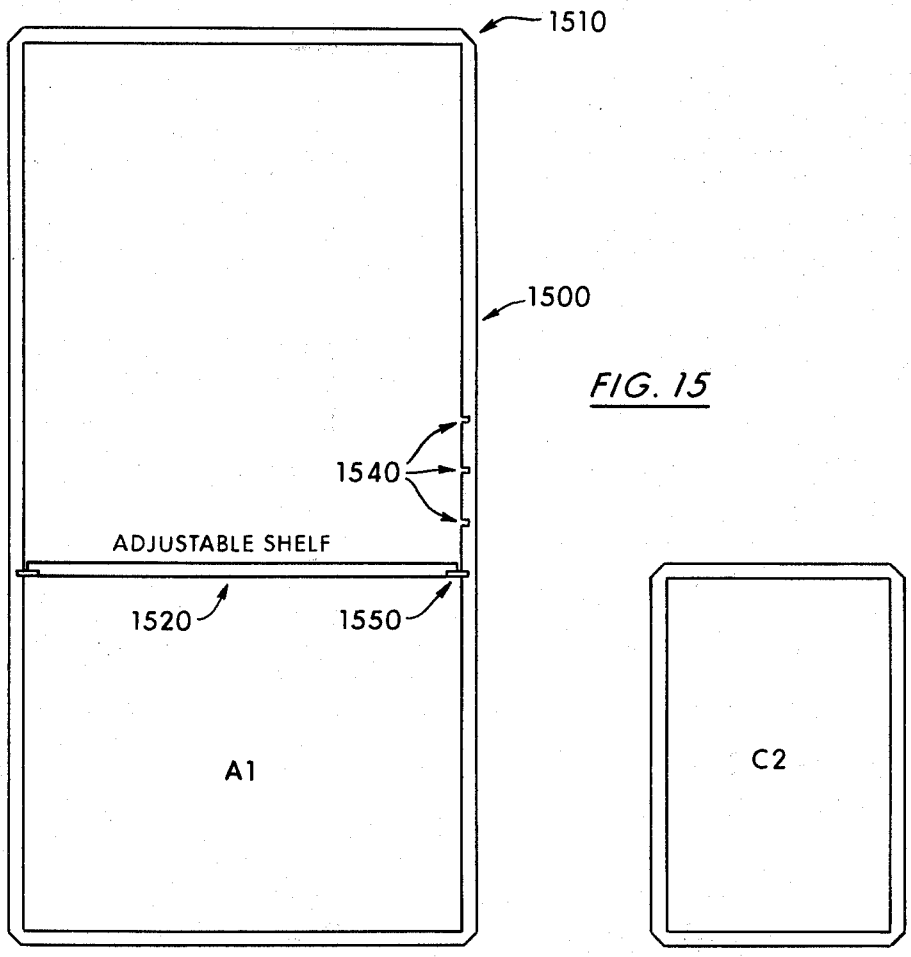
FIG. 15
FIG. 14
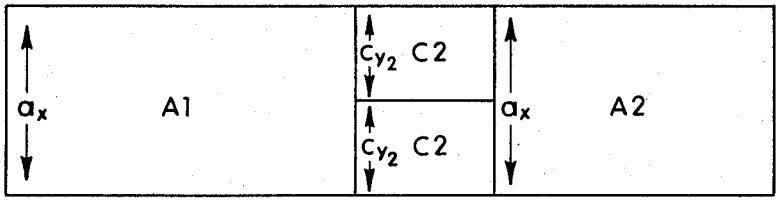

NESTABLE UNITIZED SHELVING SYSTEM

BACKGROUND OF THE INVENTION

1. Field of the Invention

This invention relates to shelving systems and in particular to shelving systems that have independent units.

2. Discussion of the Prior Art

Prior to filing for this application, the inventor effectuated a search of available prior art and uncovered the following patents:

| | | | |
|---|---|---|---|
| Szabady (Austrian) | | 41,098 | Oct. 1, 1909 |
| Dismuke | | 3,316,862 | May 2, 1967 |
| Tisdall et al | | 3,368,856 | Feb. 13, 1968 |
| Marcolongo | | 3,552,817 | Jan. 5, 1971 |
| Bucholz | | 3,695,190 | Oct. 3, 1972 |
| Pangburn et al | | 3,754,805 | Aug. 28, 1973 |
| Moretini | Des. | 232,893 | Sept. 24, 1974 |
| Horney | Des. | 236,411 | Aug. 26, 1975 |

The 1971 patent to Marcolongo sets forth a unitized interlocking storage cabinet as best shown by reference to FIG. 5. Marcolongo discloses a plurality of units (1A-1G) which stack to interconnect as shown in FIG. 5. Each separate unit is a prismatic box having an open front and rear of rectangular configuration. The height of each rectangular configuration represents a unit size and the width is a multiple of that size. Thus, for example, by reference to FIG. 5, the width of unit 1A is ⅓ of its length. Or, unit 10 has a width which is ½ of its length. Due to this arrangement, the units can be interlocked into varying configurations. The 1973 patent issued to Pangburn et al sets forth a funeral urn storage system. It is comprised of a plurality of rectangular storage member 12 having an open front.

The most pertinent prior patent however appears to be the Austrian Patent issued in 1909 which relates to a nestable table arrangement consisting of four tables and two stools. The Austrian approach, however, relates to a table set wherein the individual tables can be pushed together into a nestable relationship. The four tables are of the same height. The remaining patents discovered in the search relate to the field of the invention but are not as close to the present invention as those already discussed.

However, when viewing the Austrian patent and all of the above prior art, either individually or taken together, it became apparent that the present invention was novel over these existing prior art approaches. Specifically, the present invention was designed after much experimentation and analysis to arrive at certain relationships occurring between the various units. None of the above prior art approaches suggest any such relationships nor do they discuss or suggest separate shelving units of differing heights and widths which may be conveniently rearranged at any time by the user without the aid of tools or the like and which can be quickly and conveniently nested for transportation to another area.

Hence, the shelving units of the present invention can accomodate a wide range of items including different sized books, stereo equipment, record albums, plants, and art objects and can be set up and used in different sized environmental surroundings. Yet, to facilitate ease and moving and storage, the novel system of the present invention nests quickly within the largest unit.

OBJECTS

It is an object of the present invention to provide a new and novel unitized shelving system.

It is another object of the present invention to provide a new and novel unitized shelving system which is completely nestable for storage or transportation.

It is another object of the present invention to provide a new and novel unitized shelving system that contains independent stackable units.

Other objects, advantages and capabilities of the present invention will become more apparent as the description proceeds, taken in conjunction with the accompanying drawing.

DESCRIPTION OF THE DRAWING

FIG. 14 sets forth the congruency relationships for the width of Unit A1 of the Series One Units.

FIG. 15 sets forth shelf location.

SUMMARY OF THE INVENTION

A nestable shelving system comprising a plurality of rectangular units wherein each of the units has sidewalls of predetermined thicknesses. A first series of shelving units is utilized wherein each unit of the first series varies in height from the next taller unit by a predetermined amount and where each unit also varies in width from the next wider unit by the same predetermined amount. The predetermined amount being equal to at least twice the wall thickness. A second series of units is also utilized wherein each unit in the second series varies in height from the next taller unit by the predetermined amount and wherein each unit varies in width from the next wider unit by the same predetermined amount. The widths of each unit in the second series correspond to the width of each unit in the first series. The largest unit of the second series is designed to contain all of the smaller units of the second series and is further designed to engage the interior of the smallest unit of the first series in an orthogonal relationship so that the openings of the first units are orthogonal to the openings of the second units when nested. The units in the first series and in the second series are further designed according to certain primary congruency relationships in order to provide the stacking of the units to form, for example, a book shelf unit of differing predetermined sizes wherein the predetermined sizes correspond to the height of the units in the first series.

DETAILED SPECIFICATION

Figures 1, 2:
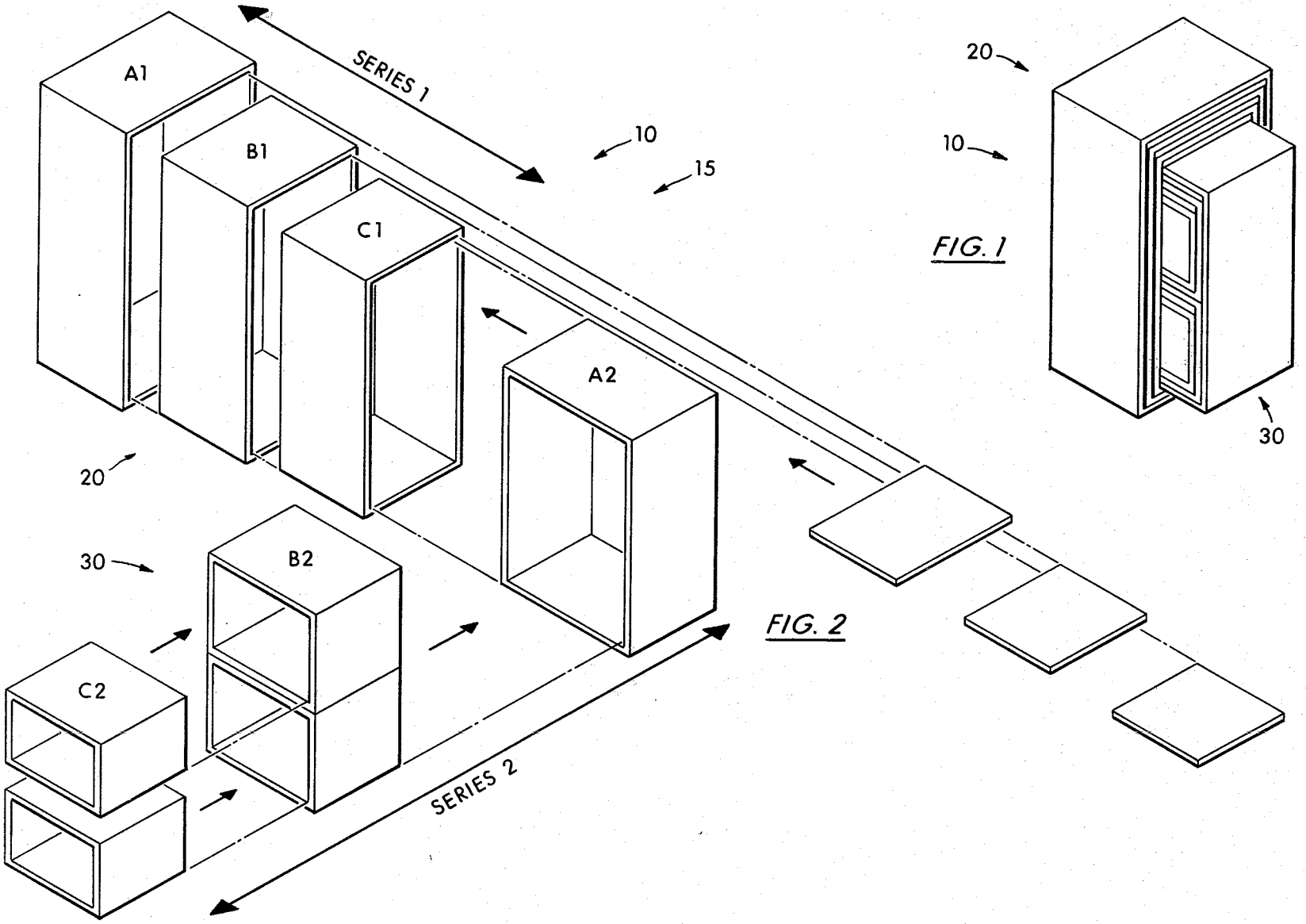
FIG. 1 illustrates the unitized shelving system of the present invention in the nestable arrangement for storage or transportation.
FIG. 2 illustrates the technique of nesting the unitized shelving system of the present invention.

In FIG. 1, is shown the unitized shelving system 10 of the present invention in the nested arrangement. The system 10 includes a first series of shelving units 20 (hereinafter termed "Series One Units") and a second series of shelving units 30 (hereinafter termed "Series Two Units") wherein the second series 30 is inserted orthogonally to the first series. As shown in FIG. 1, this nestable system can be easily transported or stored.

FIG. 2 sets forth the insertion of the Series One and Series Two Units into the nesting relationship as shown in FIG. 1. Specifically, the Series One Units, in the preferred embodiment, are composed of three units designated A1, B1, and C1. The Series Two units contain five units: an A2 unit, two B2 units and two C2 units. Nestable shelves 15 are also provided.

The Series One units 20 are designed so that unit C1 nests completely within unit B2 and unit B2 nests completely in unit A1 to obtain the configuration as shown in FIG. 1 for Series One 20. Furthermore, Series Two units are designed so that each unit C2 nests completely within each unit B2 and the stack of units containing unit B2 and C2 nests completely within the single unit A2. The complete Series Two units thereupon can be inserted to nest substantially within and orthogonal to unit C1 of Series One. All shelves 15 are fully insertable.

The system shown in FIGS. 1 and 2 does not require the use of any mounting or dismounting apparatus or the use of any tools. Hence, the unitized shelving system of the present invention can be quickly and rapidly assembled and disassembled for transportation or storage.

Figure 3:
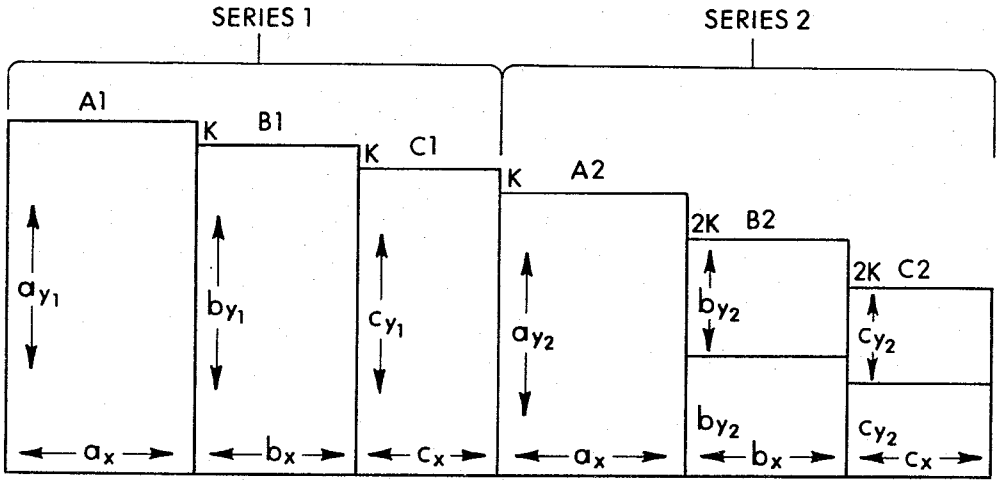
FIG. 3 sets forth the height relations existing between the Series One and the Series Two groupings of units.
Figure 4:
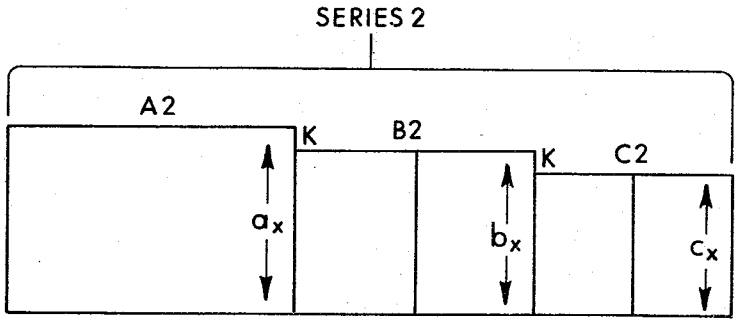
FIG. 4 sets forth the width relationship existing between the Series One and the Series Two groupings of units.
Figure 4:
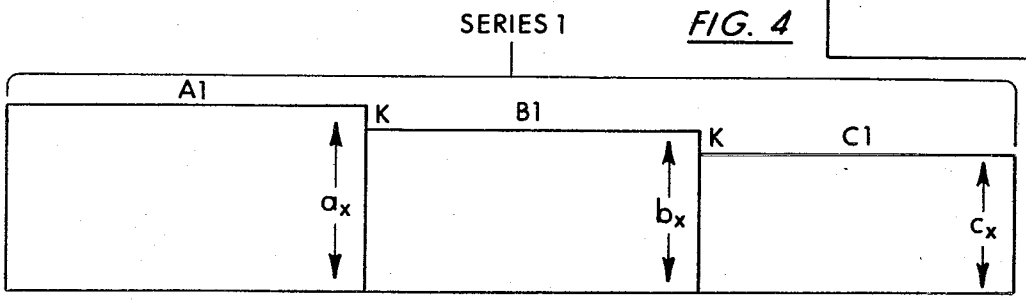

FIG. 3 sets forth the side-by-side relationships for all the units in the preferred embodiment of the present invention. At the outset, it is noted that the height (Y-axis) of the units in each series, as oriented, varies from the next tallest by a predetermined value termed k. Furthermore, the width sequence in the Series One units corresponds to the width sequence in the Series Two units. Hence, the width of unit A1 of Series One, $a_x$, is identical to the width, $a_x$, of unit A2 in Series Two. These and other relationships will be discussed more fully. The relationships between the widths of the two series, Series One and Series Two, are also shown by reference to FIG. 4. The widths of these units also varies by the value of k from the next widest unit.

The first series of units are related as follows:

| SERIES ONE NESTING RELATIONSHIPS | |
|---|---|
| X-Axis | Y-Axis |
| $a_x = b_x + k$ | $a_{yl} = b_{yl} + k$ |
| $b_x = c_x + k$ | $b_{yl} = c_{yl} + k$ |
| . | . |
| . | . |
| . | . |
| $n_x = (n + 1)\,x + k$ | $n_y = (n + 1)\,y + k$ |

where k = 2x (shelf thickness) + clearance

It can be observed by inspection of the above relationships, that more than three units in Series One can be utilized. Indeed, any number of units can be utilized in the general case represented by n. In the above relationships, the value of k is proportionate to at least twice the thickness of the shelf and it may include a suitable clearance value. The value of k can, therefore, be selected to achieve the most convenient dimensional relationship.

There also exists certain congruent relationships between the bottoms and sides of the units in Series One. These are set forth as follows:

| SERIES ONE CONGRUENT RELATIONSHIPS | |
|---|---|
| $a_{yl} = a_x + b_x = b_{y2} + c_x + c_{y2}$ | (Formula 1) |
| $b_{y1} = a_x + c_x = 2b_x = 2b_{y2} + c_{y2} = 2c_{y2} + c_x$ | (Formula 2) |
| $c_{yl} = b_x + c_x = a_x + b_{y2} = 2c_{y2} + b_{y2}$ | (Formula 3) |

Figure 5:
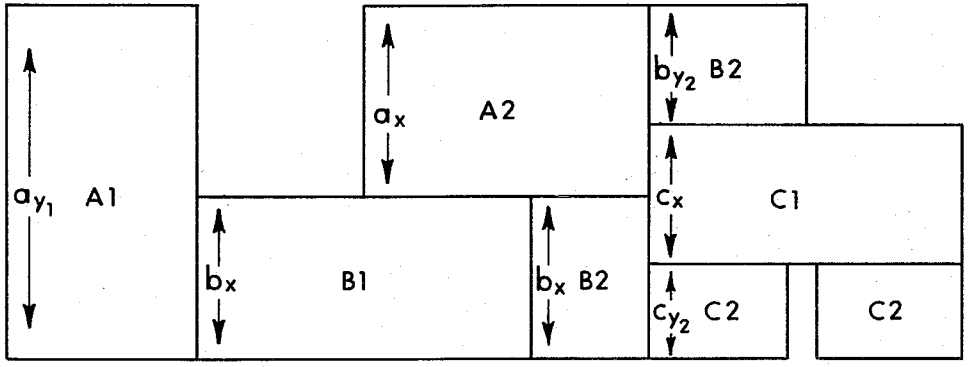
FIG. 5 sets forth the primary height congruency relationships for Unit A1 of the Series One Units.
Figure 13:
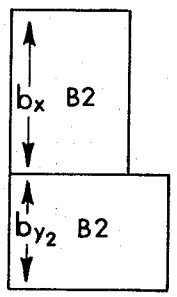
FIG. 13 sets forth additional height congruency relationships for Unit A2 of the Series Two Units.
Figure 12:
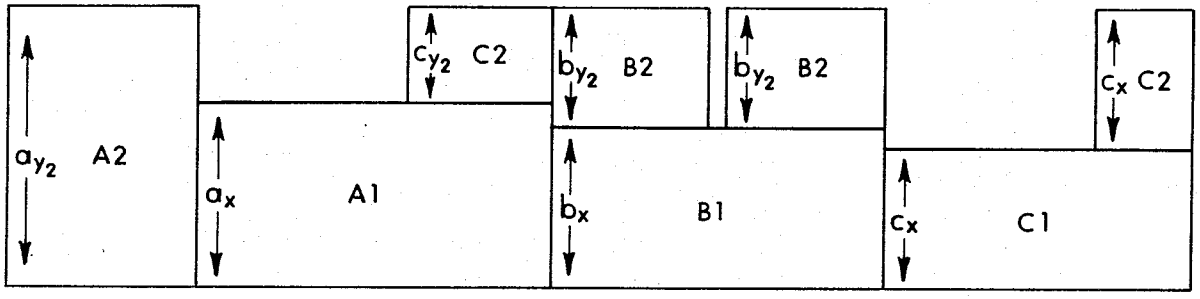
FIG. 12 sets forth the primary height congruency relationships for Unit A2 of the Series Two Units.

In FIG. 5, the congruent relationships set forth in Formula 1 are illustrated. The complete set of Series One and Series Two units of the preferred embodiment are stackable to a predetermined height of $a_{y1}$.

Figure 8:
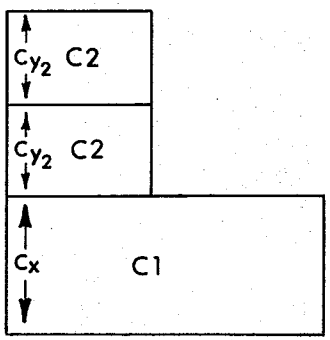
FIG. 8 sets forth additional height congruency relationships for Unit B1 of the Series One Units.
Figure 7:
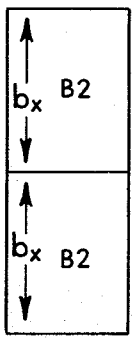
FIG. 7 sets forth additional height congruency relationships for Unit B1 of the Series One Units.
Figure 6:
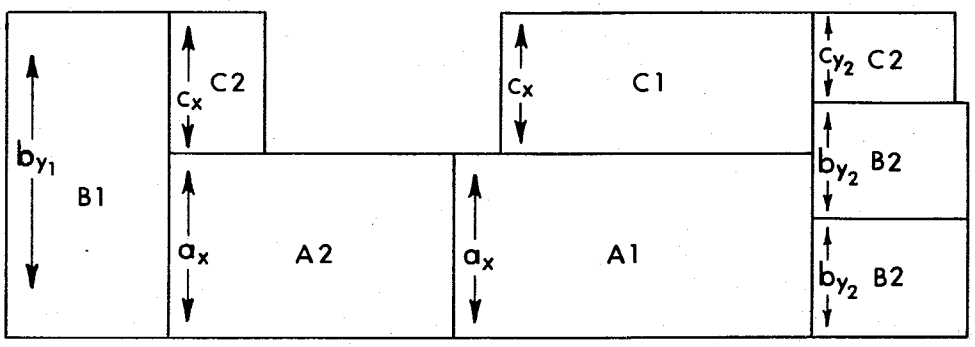
FIG. 6 sets forth the primary height congruency relationships for Unit B1 of the Series One Units.

In FIGS. 6, 7, and 8, the congruent relationships are set forth for Formula 2 (height $b_{y1}$). It is to be noted, that the configuration shown in FIG. 6 of the preferred embodiment utilizes all units of Series One and Series Two in an arrangement which has an overall stackable height of $b_{y1}$.

Figure 11:
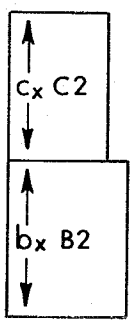
FIG. 11 sets forth additional height congruency relationships for Unit C1 of the Series One Units.
Figure 10:
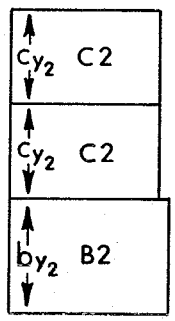
FIG. 10 sets forth additional height congruency relationships for Unit C1 of the Series One Units.
Figure 9:
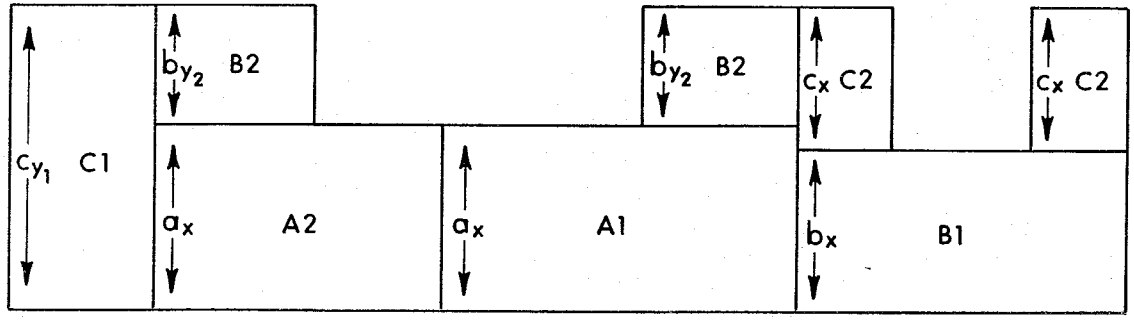
FIG. 9 sets forth the primary height congruency relationships for Unit C1 of the Series One Units.

In FIGS. 9, 10, and 11, are set forth the congruent relationships of Formula 3. For example, in FIG. 6, all units of the preferred embodiment are arranged to achieve an overall stackable height of $c_{y1}$.

Certain of the congruent relationships can be expressed as set forth in Table 1 below:

TABLE 1

| | $a_x$ | $b_x$ | $c_x$ |
|---|---|---|---|
| $a_y$ | x | x | |
| $b_y$ | x | | x |
| $c_y$ | | x | x |

It is observed that first height, $a_y$, is equal to the largest sum of any two sides of $a_x$, $b_x$ and $c_x$. Side $b_y$ is equal to the next largest sum and side $c_y$ is equal to the third largest sum.

The second series of units also undergoes nesting and congruency relationships including certain transitional relationships with Series One. The Series Two nesting relationships are set forth below.

| SERIES TWO NESTING RELATIONSHIPS | |
|---|---|
| X-Axis | Y-Axis |
| $a_x = b_x + k$ | $a_{y2} = 2b_{y2} + 2k$ |
| $b_x = c_x + k$ | $b_{y2} = c_{y2} + k$ |
| . | . |
| . | . |
| . | . |
| $n_x = (n + 1)_x + k$ | $p_y = (p + 1)_y + k$ |

It is to be noted that the Series Two units on the X-axis have the same dimensional size and relationship as the Series One units as evident in FIG. 3. Furthermore, the same general relationship exists on the Y-axis of the Series Two units. The primary difference, however, being that the first unit A2 is a single unit whereas the remaining units B2 and C2 are half-size. Otherwise, the same general relationship exists on the Y-axis as was found for Series One.

Certain transitional nesting relationships also exist between Series One and Series Two. These are:

| TRANSITIONAL NESTING RELATIONSHIPS | |
|---|---|
| $c_{yl} = a_{y2} + k$ | (Formula 4) |
| $c_x = b_{y2} + k$ | (Formula 5) |

It is to be noted that Formula 4 represents the same nesting relationship between the two series as is found in the individual series. Furthermore, Formula 5 sets forth a nesting relationship existing between the width $c_x$ and the height $b_{y2}$.

At this time, one overall nesting relationship should be commented on. That is the fact that any given side of any given unit is related to the value of k by an integer relationship. Hence, any side of any unit = NK (Formula 6)

where N = integer 1, 2, 3, . . . n

Hence, as set forth in FIGS. 1 and 2, all units of the shelving system 10 of the present invention are fully nestable one within the other separated only by a clearance value between each given unit.

The Series Two primary congruency relationships are set forth as follows:

| SERIES TWO CONGRUENCY RELATIONSHIPS | |
|---|---|
| $a_{y2} = 2c_x = c_{y2} + a_x = b_{y2} + b_x$ | (Formula 7) |
| $2c_{y2} = a_x$ | (Formula 8) |

FIG. 15 sets forth the congruency relationships set forth in Formula 7. It is to be noted that all units of the preferred shelving system are arrangeable to line up to a predetermined height of $a_{y2}$. Finally, in FIG. 16 the congruency relationship in Formula 8 is set forth.

From an inspection of the above Figures it is clear that the Series One and Two units can be arranged in a number of configurations wherein the certain predetermined heights of $a_{y1}$, $b_{y1}$, $c_{y1}$, and $a_{y2}$ are achieved. Yet, the units are nestable, one within the other. Such concepts (i.e. predetermined heights v. differing heights) appear to be contradictory and unobtainable. Yet by adhering to the above relationships, the present invention accomplishes both of these concepts.

In the preferred embodiment, the following dimensions are used:

TABLE 2

| PREFERRED EMBODIMENT k = 2½ inches | | |
|---|---|---|
| Unit Side | Dimension (Inches) | N |
| $a_{yl}$ | 37½ | 15 |
| $b_{yl}$ | 35 | 14 |
| $c_{yl}$ | 32½ | 13 |
| $a_{y2}$ | 30 | 12 |
| $b_{y2}$ | 12½ | 5 |
| $c_{y2}$ | 10 | 4 |
| $a_x$ | 20 | 8 |
| $b_x$ | 17½ | 7 |
| $c_x$ | 15 | 6 |

The thickness of the side wall of each side of any unit in the preferred embodiment is ¾ inch. Hence, if k=2½", the clearance value is 1". Furthermore, Table 2 sets forth the value of N under Formula 6.

An additional optional feature of the present invention relates to the location of adjustable shelves in the various units. The location of the shelf support is as follows:

$$\text{shelf interval} = \frac{nk}{2} \qquad \text{(Formula 9)}$$

where $n$ = an interger

Hence, as shown in FIG. 15, unit A1 is composed of a vertical side 1500, $a_{y1}$, whose height is 15k (or 15×2½ inches). Sides 1500 are made from ¾" thick lumber and are conventionally interconnected at points 1510.

The shelf supports 1550 are spaced at 1¼" intervals in the preferred embodiment. Hence, if the shelf support occupies ½" and the shelf 1520 is ¾" thick, the shelf 1520 lines up with the upper surface of unit C2. That is, unit C2 is 8×2½" or 20" high while shelf 1520 is located 20" high. From Formula 9:

$$n = \frac{2(\text{shelf interval})}{k}$$

where:

shelf interval = 20"

$k$ = 2½"

$n$ = 16

Hence, a plurality of removable shelves can be optionally supplied with the unitized shelving system of the invention. In the preferred embodiment, the shelves would have lengths substantially corresponding, but not limited to, the following dimensional values:

$a_x - 2(st)$
$b_x - 2(st)$
$c_x - 2(st)$
$a_{y1} - 2(st)$
$b_{y1} - 2(st)$
$c_{y1} - 2(st)$
$a_{y2} - 2(st)$ where st = side thickness Since the units of the invention can occupy any orientation, the shelf supports may be placed on all interior sides of units A1, B1, C1, and A2 in the preferred invention.

It is to be noted that the shelves are nestable within the system. As mentioned the clearance is one inch, hence with the shelf thickness being ¾", a shelf of appropriate dimension can be nested.

For example, in the preferred embodiment, four shelves corresponding to a length of $a_x - 2(st)$ are provided, two shelves corresponding to a length of $b_x - 2(st)$ are provided and two shelves corresponding to a length of $c_x - 2(st)$ are provided. These shelves are fully nestable into the system as shown in FIG. 1.

Finally, the depth of each unit must be less than the value of $c_x - 2(st)$ so that the Series Two units can engage the interior of unit C1.

Although the present invention has been described with a certain degree of particularity, it is understood that the present disclosure has been made by way of example and that changes in details of structure may be made without departing from the spirit thereof.

I claim:

1. A nestable shelving system comprising rectangular units, each of said units having sides of a predetermined wall thickness, said system comprising:

a first series of three shelving units (A1, B1, and C1), said first series having each unit varying in height from the next taller unit by an amount termed "k", where K amount equals at least twice said wall thickness, and having such unit varying in width from the next wider unit by said amount "k" each of said shelving units having the same predetermined shelf depth, a second series of three shelving units (A2, B2, and C2), said second series having each unit varying in height from the next taller unit by said amount "k", and having each unit varying in width from the next wider unit by said amount "k", the widths of each unit in said second series corresponding to the widths of corresponding units in said first series each of said shelving units having the same aforesaid predetermined shelf depth, the largest unit of second series being capable of containing all of the smaller units of said second series and being capable of engaging the interior of the smallest unit of said first series in an orthogonal relationship so that the openings of said first units are orthogonal to the openings of said second units when nested, said three units A1, B1, and C1 of said first series having the following congruent relationships:

1. $a_{y1}=a_x+b_x$
2. $b_{y1}=a_x+c_x$
3. $c_{y1}=b_x+c_x$ where $a_{y1}$=height of Unit A1

$a_x$=width of Unit A1=width of Unit A2

$b_{y1}$=height of Unit B1

$b_x$=width of Unit B1=width of Unit B2

$c_{y1}$=height of Unit C1

$c_x$=width of Unit C1=width of Unit C2 said three units A2, B2 and C2 of said second series having the following congruent relationships:

1. $a_{y2}=2c_x$
2. $2c_{y2}=a_x$ where:

$a_{y2}$=height of Unit A2

$c_{y2}$=height of Unit C2 wherein said first series of units is related to said second series of units by:

1. $c_{y1}=a_{y2}+k$
2. $c_x=b_{y2}+k$ where:

$b_{y2}$=height of unit B2, said first and second units when un-nested being capable of being stacked in a number of different configurations, each of said configurations having a uniform height throughout, and wherein the depth of each unit is less than the value of $c_x$ minus twice said wall thickness.

* * * * *